US008627811B1

(12) United States Patent
Darlington

(10) Patent No.: US 8,627,811 B1
(45) Date of Patent: Jan. 14, 2014

(54) COMPOUND ARCHERY CROSSBOW

(76) Inventor: Rex F. Darlington, Whittemore, MI (US)

( * ) Notice: Subject to any disclaimer, the term of this patent is extended or adjusted under 35 U.S.C. 154(b) by 340 days.

(21) Appl. No.: 13/117,944

(22) Filed: May 27, 2011

(51) Int. Cl.
*F41B 5/12* (2006.01)
*F41B 5/20* (2006.01)
*F41B 5/14* (2006.01)

(52) U.S. Cl.
CPC ..... *F41B 5/123* (2013.01); *F41B 5/1426* (2013.01)
USPC ..... 124/25; 124/86; 124/88; 124/89; 124/90

(58) Field of Classification Search
CPC ..... F41B 5/123; F41B 5/14; F41B 5/1426
USPC ..... 124/25, 86, 88, 89, 90
See application file for complete search history.

(56) References Cited

U.S. PATENT DOCUMENTS

| | | | | |
|---|---|---|---|---|
| 4,716,880 | A * | 1/1988 | Adkins | 124/25 |
| 5,119,797 | A * | 6/1992 | Anderson | 124/25 |
| 5,553,596 | A * | 9/1996 | Bednar | 124/25 |
| 6,543,432 | B2 * | 4/2003 | Andrews et al. | 124/23.1 |
| 6,758,205 | B2 * | 7/2004 | Kronfeld | 124/89 |
| 6,966,314 | B2 * | 11/2005 | McPherson | 124/89 |
| 7,178,514 | B2 * | 2/2007 | Chang | 124/25 |
| 7,455,059 | B2 * | 11/2008 | Shaffer | 124/25 |
| 7,624,724 | B2 * | 12/2009 | Bednar et al. | 124/25 |
| 8,033,275 | B2 * | 10/2011 | Bednar et al. | 124/25 |
| 8,061,339 | B2 * | 11/2011 | Shaffer | 124/25 |
| 8,141,548 | B2 * | 3/2012 | Leven | 124/89 |
| 8,225,777 | B2 * | 7/2012 | Chu | 124/25 |
| 8,365,713 | B2 * | 2/2013 | Grace, Jr. | 124/89 |
| 2006/0137670 | A1 * | 6/2006 | Shaffer | 124/25 |
| 2009/0133683 | A1 * | 5/2009 | Wright | 124/89 |
| 2009/0178657 | A1 * | 7/2009 | Shaffer | 124/25 |
| 2011/0271938 | A1 * | 11/2011 | Chu | 124/25 |
| 2012/0006311 | A1 * | 1/2012 | Bednar et al. | 124/25 |

* cited by examiner

*Primary Examiner* — Gene Kim
*Assistant Examiner* — Alexander Niconovich
(74) *Attorney, Agent, or Firm* — Reising Ethington PC

(57) ABSTRACT

A crossbow includes a riser having projecting limbs with first and second pulleys mounted on the limbs for rotation around respective axes. A barrel extends from the riser, and a bowstring cable extends between the pulleys outside of the barrel for engaging and propelling a projectile. A pair of pulley rotation power cables extend between the pulleys through slots in the barrel, and a spacer is disposed adjacent to the riser and disposed in the barrel for engagement by the pulley rotation power cables at the end of the power stroke to dampen vibration from the riser and cables to absorb vibration that otherwise might be transmitted to the barrel.

10 Claims, 5 Drawing Sheets

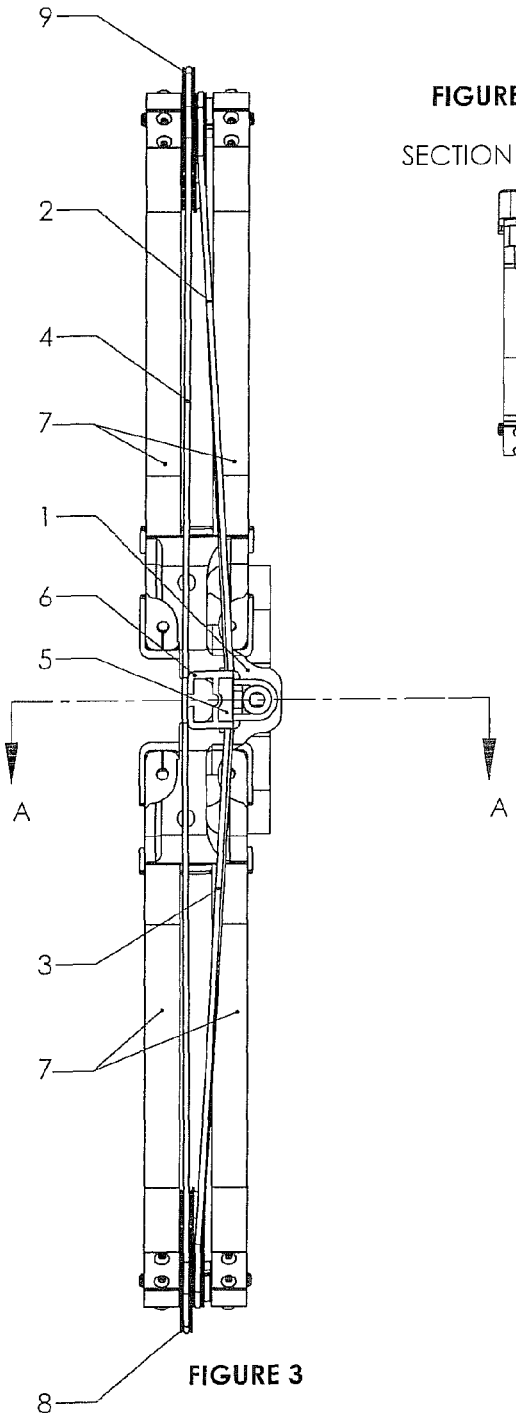
FIGURE 3
FIGURE 4
SECTION A-A
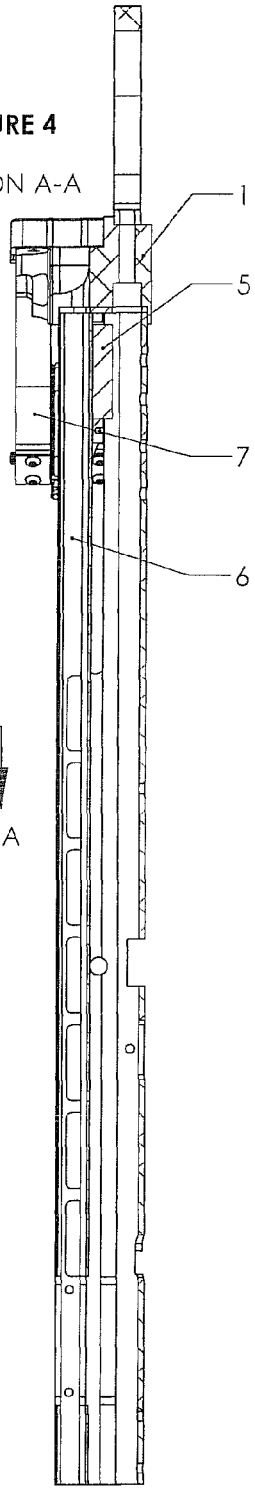
FIGURE 5
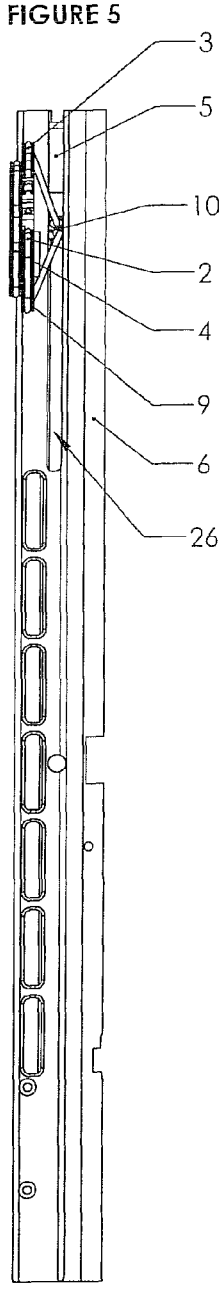

COMPOUND ARCHERY CROSSBOW

The present disclosure is directed to a compound archery crossbow having a vibration damper.

BACKGROUND AND SUMMARY OF THE DISCLOSURE

A general object of the present disclosure is to provide a compound archery crossbow having a spacer element disposed in the bow barrel for engagement by the pulley rotation power cables to dampen noise and vibration when the crossbow is shot.

A crossbow in accordance with one aspect of the present disclosure includes a riser having projecting limbs with first and second pulleys mounted on the limbs for rotation around respective axes. A barrel extends from the riser, and a bowstring cable extends between the pulleys outside of the barrel for engaging and propelling a projectile. A pair of pulley rotation power cables extend between the pulleys through a slot in the barrel, and a spacer is disposed adjacent to the riser within the barrel for engagement by the pulley rotation power cables at the end of the power stroke to dampen vibration from the riser and cables to absorb vibration that otherwise might be transmitted to the barrel.

BRIEF DESCRIPTION OF THE DRAWINGS

The disclosure, together with additional objects, features, advantages and aspects thereof, will best be understood from the following description, the appended claims and the accompanying drawings, in which:

FIG. 3 is an end elevational view of the crossbow in FIGS. 1 and 2;

FIG. 4 is a sectional view taken substantially along the line A-A in FIG. 3;

FIG. 5 is a fragmentary elevational view of a portion of the crossbow illustrated in FIGS. 1-4;

DETAILED DESCRIPTION OF PREFERRED EMBODIMENTS

Figure 1:
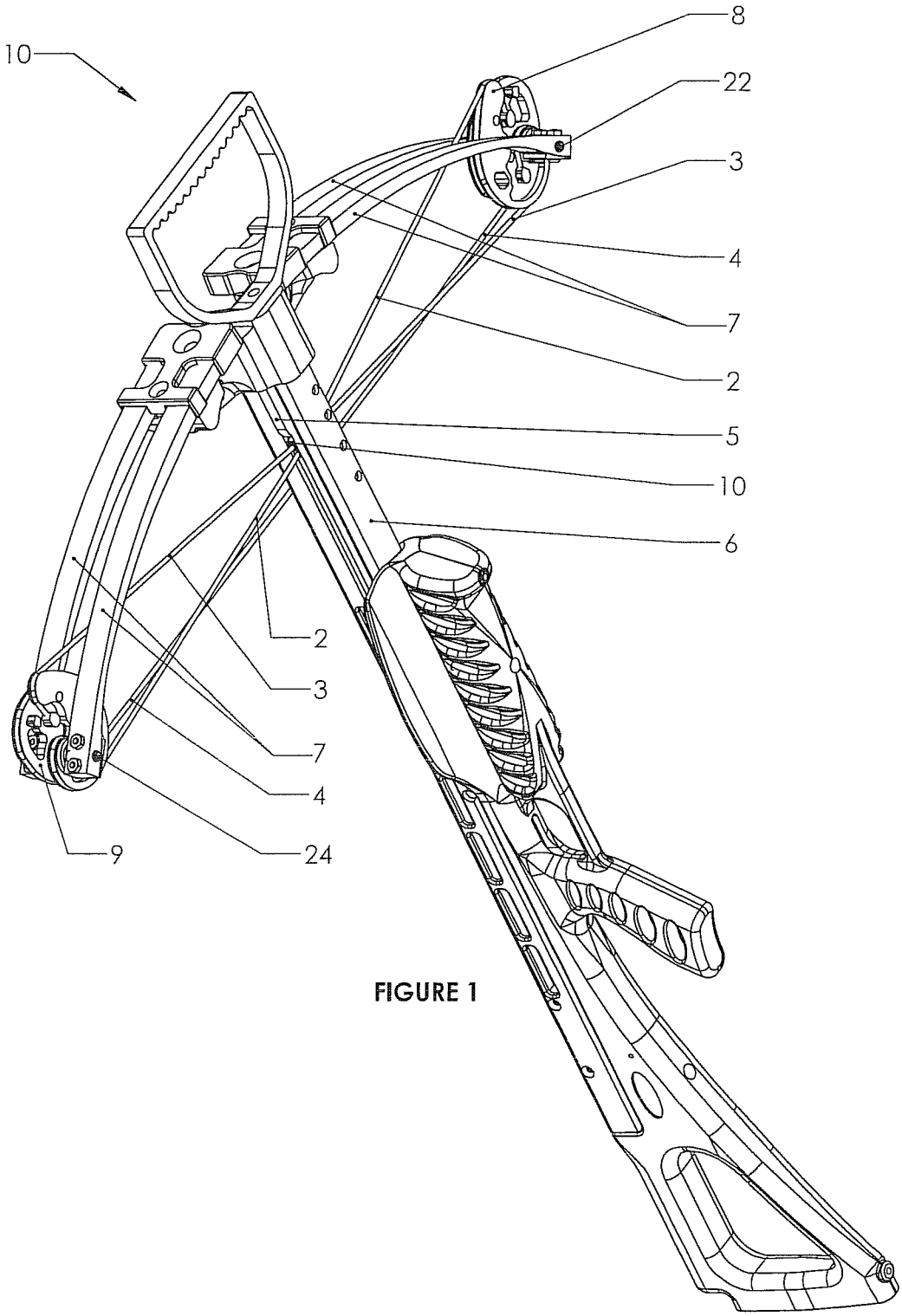
FIG. 1 is a perspective view of a compound archery crossbow in accordance with an exemplary embodiment of the disclosure.
Figure 2:
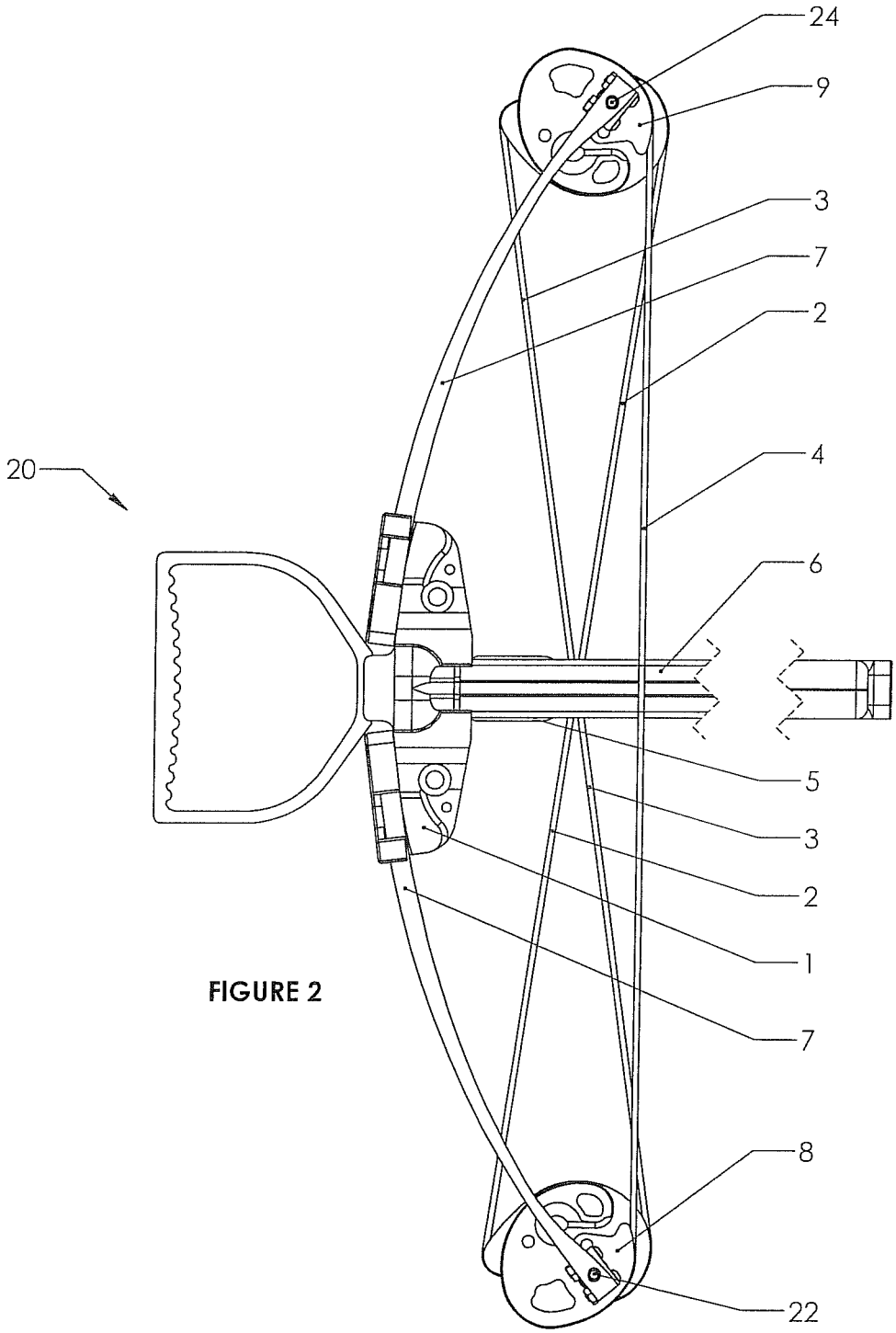
FIG. 2 is a top plan view of the crossbow illustrated in FIG. 1.
Figure 6:
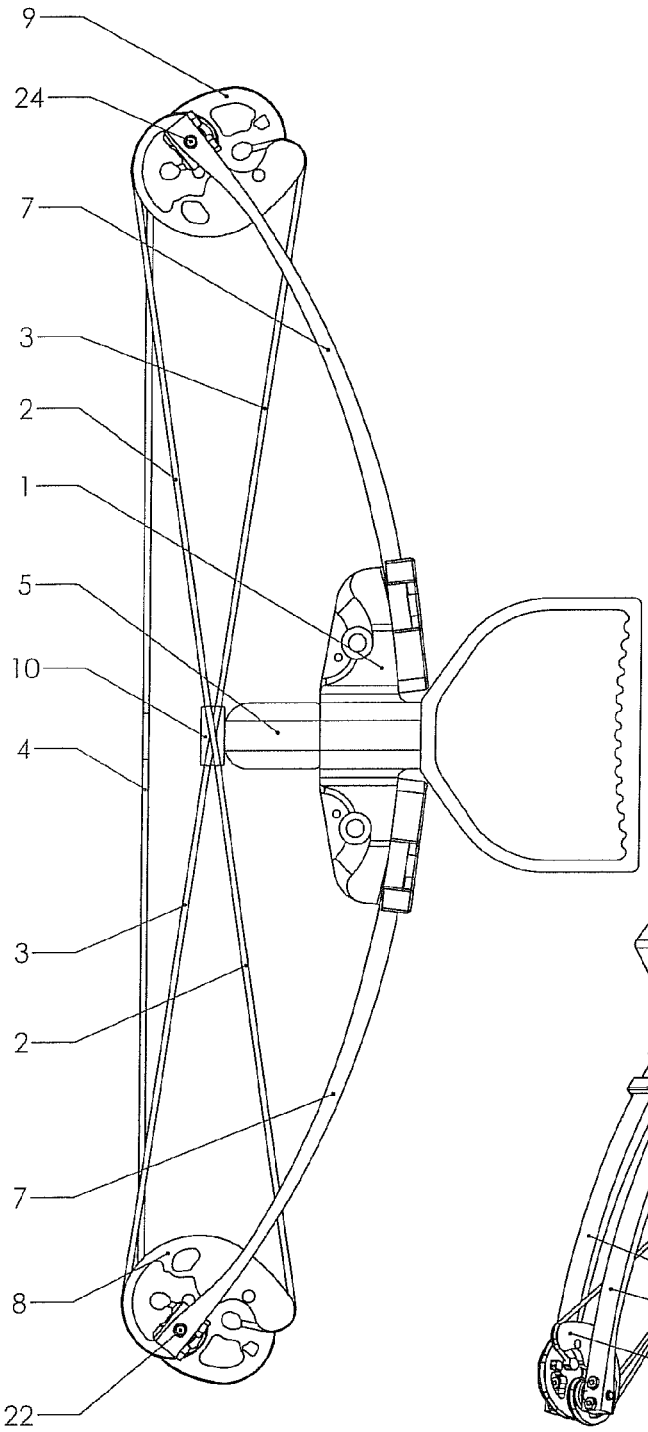
FIG. 6 is a top plan view of the riser and limb subassembly in the bow of FIGS. 1-5.
Figure 7:
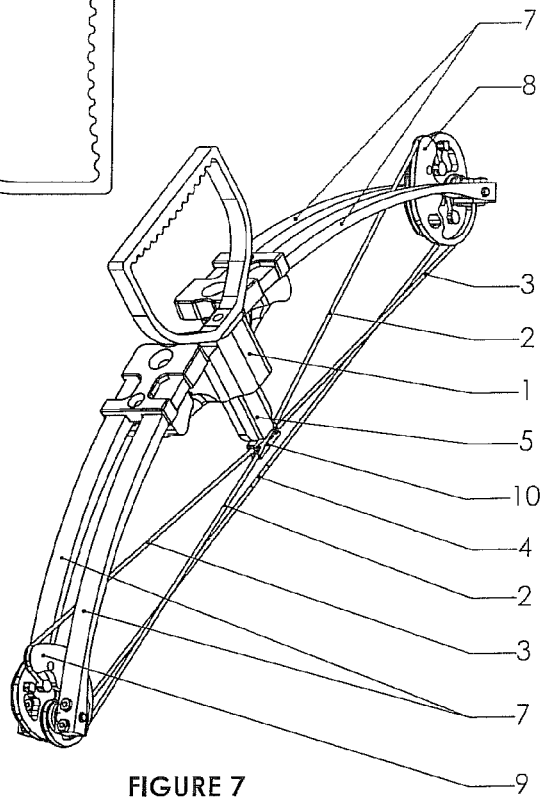
FIG. 7 is a perspective view of the subassembly illustrated in FIG. 6.
Figure 8:
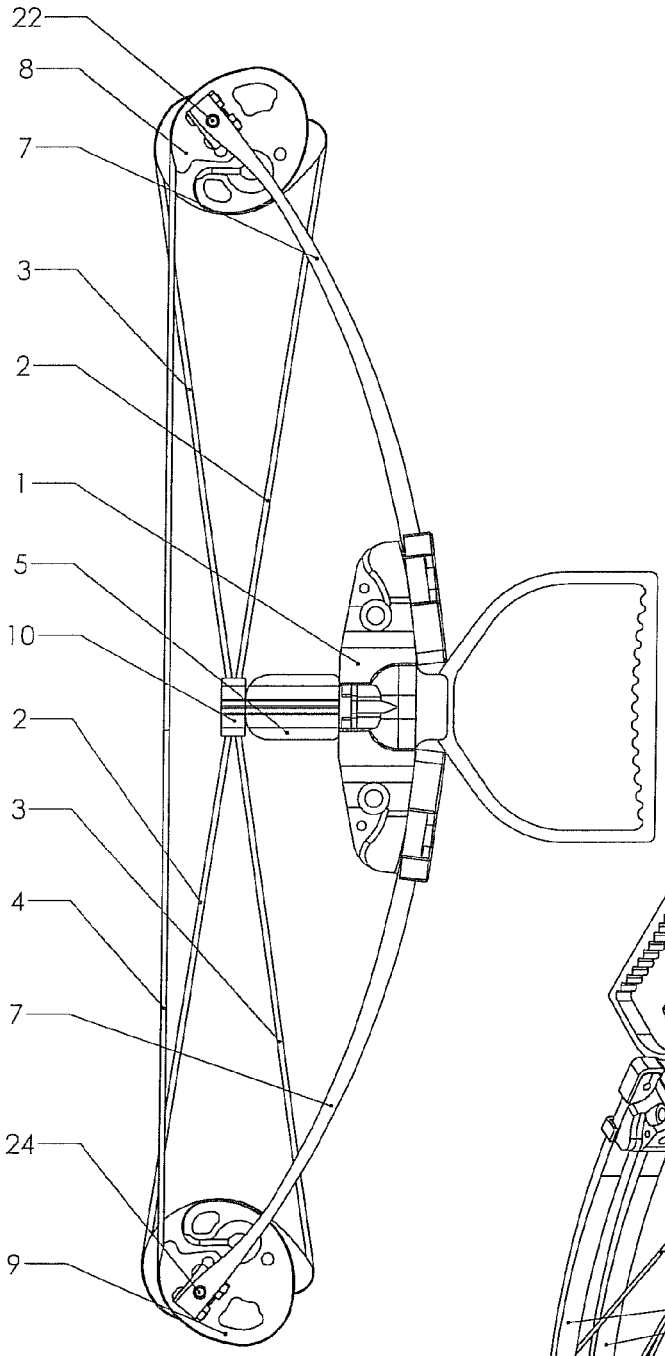
FIG. 8 is a bottom plan view of the subassembly illustrated in FIGS. 6 and 7.
Figure 9:
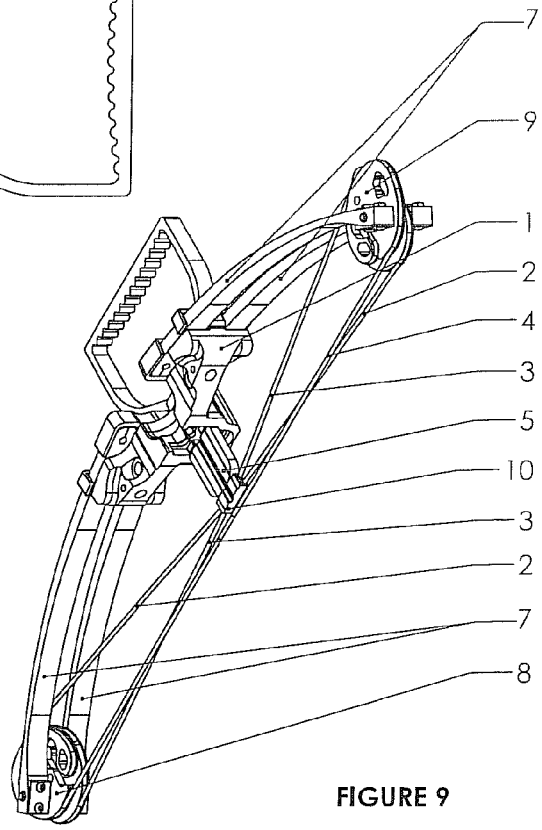
FIG. 9 is a perspective view of the subassembly illustrated in FIGS. 6-8.

FIGS. 1-5 illustrate a crossbow 20 in accordance with an exemplary embodiment of the disclosure. A pair of flexible resilient limbs 7 extend in opposed directions from a riser 1. A pair of pulleys 8, 9 are mounted on the spaced ends of limbs 7 for rotation around respective first and second axes, preferably defined by axles 22, 24. The illustrated exemplary embodiment of crossbow 20 is a dual-cam crossbow in which pulleys 8, 9 are similar in function and preferably substantially mirror images of each other. (Some pulleys can be made non-identical in areas that are non-functional to create a desired difference in appearance.) Crossbow 20 could comprise a single-cam crossbow in which one of the pulleys comprises an idler pulley or sheave.

A barrel 6 is secured to and extends from riser 1. Barrel 6 can be of extruded metal construction or molded plastic construction, for example. Barrel 6 has a through-slot 26 that opens laterally outwardly from each side of the barrel in directions facing pulleys 8, 9. A bowstring cable 4 extends between pulleys 8, 9 outside of barrel 6 for engaging a projectile. A pair of pulley rotation power cables 2, 3 extend between pulleys 8, 9 through slots 26 in barrel 6. Cables 2, 3 control rotation of pulleys 8, 9 with respect to each other and load the limbs as bowstring cable 4 is drawn and released. In the illustrated exemplary embodiment, cables 2, 3 are anchored at pulleys 8, 9. As an alternative, cable 2 could be anchored at axle 24 and/or cable 3 could be anchored at axle 22, or anchored to the limbs themselves. Cables 2, 3 cross each other within a guide 10 that is slidably mounted within the interior of barrel 6. Guide 10 preferably functions to keep cables 2, 3 from engaging and abrading against the edges of slot 26 in barrel 6. The cables could slide on the edges of the slot, but this is not preferred.

A barrel support spacer 5 is disposed adjacent to riser 1 and disposed within the interior of barrel 6. Spacer 5 can be mounted on riser 1. As best seen in FIG. 4, barrel support spacer 5 preferably engages the interior surface of hollow barrel 6 so as to help support the barrel on and adjacent to the riser 1. Spacer 5 additionally is sized and disposed for engagement by guide 10 at the end of the projectile-release stroke, as best seen in FIGS. 1 and 5, to cushion the end of the projectile-release stroke, minimize vibration of the bow and help deaden noise transmitted from the riser when the crossbow is shot. Barrel support spacer 5 preferably is of durable synthetic foam construction having a density in the preferred range of 10 to 35 lbs/cu ft, most preferably in the range of 15 to 20 lbs/cu ft. Flexible urethane foam is an exemplary presently preferred material for barrel support spacer 5.

There thus has been disclosed a crossbow that fully satisfies all of the objects and aims previously set forth. The crossbow has been disclosed in conjunction with a presently preferred embodiment, and modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A crossbow that includes:

a riser having projecting limbs, first and second pulleys mounted on said limbs for rotation around respective first and second axes, a barrel secured to and extending from said riser and having laterally opening through slots facing said pulleys and having a hollow interior therebetween with interior surfaces, a bowstring cable extending between said pulleys outside of said barrel for engaging a projectile, a pair of pulley rotation power cables extending between said pulleys through a slot in said barrel, and a spacer disposed adjacent to and in contact with said riser within said barrel for engagement by said pulley rotation power cables at an end of outward flexure of said limbs to fire the projectile, said spacer being carried in said hollow interior of said barrel in contact with said interior surfaces thereof, and extending across said hollow interior between said slots, to help support said barrel on said riser and to dampen vibration and help deaden noise transmitted from said riser when the crossbow is shot.

2. The crossbow set forth in claim 1 including a guide engaged by said pulley rotation power cables and disposed in said barrel to guide motion of said cables within said barrel and to engage said spacer.

3. The crossbow set forth in claim 1 wherein said spacer is of medium density synthetic foam construction.

4. The crossbow set forth in claim 3 wherein said spacer has a density in the range of 10 to 35 lbs/cu ft.

5. The crossbow set forth in claim 4 wherein said spacer has a density in the range of 15 to 20 lbs/cu ft.

6. The crossbow set forth in claim 3 wherein said spacer is of flexible urethane foam construction.

7. A crossbow that includes:

a riser having projecting limbs, first and second pulleys mounted on said limbs for rotation around respective first and second axes, a barrel extending from said riser and having laterally opening through slots facing said pulleys and having a hollow interior therebetween with interior surfaces, a bowstring cable extending between said pulleys outside of said barrel for engaging a projectile, a pair of pulley rotation power cables extending between said pulleys through said slots, a guide engaged with said pulley rotation power cables and disposed in said barrel, and a spacer of medium density flexible foam construction disposed adjacent to and in contact with said riser within said barrel for engagement by said guide at an end of outward flexure of said limbs to fire the projectile, said spacer being carried in said hollow interior of said barrel in contact with said interior surfaces thereof, and extending across said hollow interior between said slots, to help support said barrel on said riser and to dampen vibration and help deaden noise transmitted from said riser when the crossbow is shot.

8. The crossbow set forth in claim 7 wherein said spacer has a density in the range of 10 to 35 lbs/cu ft.

9. The crossbow set forth in claim 8 wherein said spacer has a density in the range of 15 to 20 lbs/cu ft.

10. The crossbow set forth in claim 7 wherein said spacer is of flexible urethane foam construction.

* * * * *